US006311801B1

(12) United States Patent
Takagi et al.

(10) Patent No.: US 6,311,801 B1
(45) Date of Patent: Nov. 6, 2001

(54) BRAKE CONTROL APPARATUS WITH AUXILIARY POWER SOURCE MEANS

(76) Inventors: Hiroyuki Takagi; Shigeki Yamakawa, both of c/o Mitsubishi Denki Kabushiki Kaisha, 2-3, Marunouchi 2-chome, Chiyoda-ku, Tokyo 100-8310 (JP)

( * ) Notice: Subject to any disclaimer, the term of this patent is extended or adjusted under 35 U.S.C. 154(b) by 0 days.

(21) Appl. No.: 09/564,478

(22) Filed: May 3, 2000

Related U.S. Application Data

(63) Continuation of application No. PCT/JP99/00273, filed on Jan. 25, 1999.

(51) Int. Cl.[7] ..... B66B 1/06
(52) U.S. Cl. ..... 187/290; 187/288
(58) Field of Search ..... 187/290, 291, 187/288, 207, 296; 307/64, 66

(56) References Cited

U.S. PATENT DOCUMENTS

| | | | | |
|---|---|---|---|---|
| 3,665,277 | * | 5/1972 | Velazquez | 318/447 |
| 3,687,235 | * | 8/1972 | Mitsui et al. | 187/29 R |
| 4,503,940 | * | 3/1985 | Watanabe | 187/29 R |
| 4,642,474 | * | 2/1987 | Watanabe | 187/114 |
| 4,923,055 | * | 5/1990 | Holland | 187/109 |
| 4,975,627 | * | 12/1990 | Reddy | 318/365 |
| 4,984,659 | * | 1/1991 | Nomura | 187/108 |
| 4,987,977 | * | 1/1991 | Nomura | 187/112 |
| 5,058,710 | * | 10/1991 | Iwasa | 187/114 |
| 5,077,508 | * | 12/1991 | Wycoff et al. | 318/758 |
| 5,712,456 | * | 1/1998 | McCarthy et al. | 187/290 |
| 6,039,151 | * | 3/2000 | Ringel et al. | 187/207 |
| 6,196,355 | * | 3/2001 | Fargo et al. | 187/393 |

FOREIGN PATENT DOCUMENTS

| | | | |
|---|---|---|---|
| 2-110090 | | 4/1990 | (JP) . |
| 8-26620-A | * | 1/1996 | (JP) . |
| 11-79593-A | * | 3/1999 | (JP) . |

* cited by examiner

*Primary Examiner*—Jonathan Salata

(57) ABSTRACT

A brake control apparatus for an elevator includes an auxiliary power source for storing energy for driving a brake coil of an electromagnetic brake upon release of a brake wheel. A DC voltage is boosted only when the brake is released, and the voltage-boosting function ceases when the brake is held in a released condition. This brake control apparatus for an elevator uses a lower voltage and only one DC power source and immediately supplies the necessary energy to the brake coil to release the brake independently of the power source voltage at the time.

8 Claims, 5 Drawing Sheets

BRAKE CONTROL APPARATUS WITH AUXILIARY POWER SOURCE MEANS

CROSS REFERENCE TO RELATED APPLICATION

This is a continuation of International Application PCT/JP99/00273, with an international filing date of Jan. 25, 1999.

TECHNICAL FIELD

This invention relates to an apparatus for controlling an electromagnetic brake of an elevator.

BACKGROUND ART

FIG. 6 is a schematic diagram showing a conventional elevator apparatus similar to the one disclosed in Japanese Patent Application Laid-open No. Hei 2-110090.

As illustrated, in the elevator apparatus, a drive motor 2, a brake wheel 3 and a sheave 4 that constitute a hoisting machine are attached to a common rotational shaft 1. The motor 2 is electrically connected to a motor control circuit 5, and the motor control circuit 5 is connected through a contact 6 of an electromagnetic contactor to a three-phase power source 7.

An electromagnetic brake 8 is made up of a plunger 10 attached to a lining 9 that effects the brake by clamping the brake wheel 3, a spring 12 connected between the plunger 10 and a base 11, a switch 13 opened/closed in association with the motion of the plunger 10, and a brake coil 14 wound around the plunger 10.

In the electromagnetic brake 8, the plunger 10 is depressed by the force of the spring 12, that is, the lining 9 attached to the plunger 10 is pressed onto the brake wheel 3, thereby effecting the braking force. On the other hand, if the brake coil 14 is energized through a brake control circuit 15 that controls an electric current flowing in the brake coil 14, the plunger 10 overcomes the force of the spring 12, and is attracted, to thereby release the brake wheel 3.

A rope 16 is hung over the sheave 4, and one end of the rope 16 is connected to an elevator cage 17, whereas the other end thereof is connected to a counterweight 18.

FIG. 7 is a circuit diagram showing the conventional brake control circuits 15 shown in the block diagram of FIG. 6.

In a brake control circuit 15*a* shown in FIG. 7, between a positive terminal (+) of a DC power source (not shown) and a negative terminal (−) thereof, a contact 19 of the electromagnetic contactor (not shown) which is closed at the time of the release of the electromagnetic brake 8 and is open at the time of the operation of the electromagnetic brake 8, an electric current detector 22, the brake coil 14, and a semiconductor switch 20 are connected in series. Also, a flywheel diode 21 is connected in parallel with a serially connected assembly of the electric current detector 22 and the brake coil 14. Connected to the base of the semiconductor switch 20 is a voltage-drop control circuit 23 to which the output of the electric current detector 22 is inputted to ON/OFF control the semiconductor switch 20, i.e., to control the coil current through the pulse width control, thereby substantially dropping the voltage applied to the coil.

The brake control circuit 15*a* detects electric current flowing through the brake coil 14 by means of the electric current detector 22, and controls the brake current using a chopper system in which ON/OFF control is carried out by the semiconductor switch 20.

Also, in another brake control circuit , between a positive terminal (+) of a power source and a negative terminal (−) thereof, a contact similar to contact 19 shown in FIG. 7, a contact of the switch 13 shown in FIG. 6, and the brake coil 14 shown in FIG. 6 are connected in series. Further, a resistor 24 is connected in parallel with the contact 13*a* of the switch 13, and a resistor 25 is connected in parallel with the brake coil 14.

In this case, since a large electric current is required to flow through the brake coil 14 to overcome the force of the spring 12, so the plunger 10 is attracted, the contact 13*a* is in a closed state in which the brake coil 14 is directly connected to the power supply. However, it switches to an open state using such a characteristic that once the plunger 10 is attracted, the attracted state of the plunger 10 can be maintained even if the coil current is decreased.

Also, the resistor 24 connected in parallel to the contact 13*a* serves as a current limiting resistor that limits the current flowing the brake coil 14 when the plunger 10 is attracted and the contact 13*a* is open. The resistor 25 connected in parallel with the brake coil 14 serves as a coil protection resistor that absorbs the electromagnetic energy stored in the brake coil 14 when the coil current is interrupted. The brake current is controlled by the electromagnetic contactor 13*a* and the current limiting resistor.

In either of the above-mentioned types shown in FIG. 7 and described at the time of the brake attraction, the DC power source is directly connected to the brake coil 14 to cause a large current to flow therein. This generates a large energized magnetic force, thereby achieving the immediate brake release (pick-up). Once the brake is released, the voltage applied to both ends of the brake coil 14 is dropped by the action of the semiconductor switch 20 or the resistor 24 so as to limit the current flowing in the coil, thereby attracting and holding the brake. Consequently, it is possible to suppress the heat generation of the brake coil 14 as well as to reduce electric power consumption of the coil.

However, in the case where a only single system of the DC power source is provided as a control power source, and the power source cannot supply a required and sufficient high voltage for immediately releasing the electromagnetic brake, the conventional brake control circuit cannot release the brake immediately and, at worst, never releases the brake (plunger is not attracted), and therefore the elevator can not be driven.

In particular, since the recent tendency in elevators is also directed toward down-sizing and low electric-power consumption of the control apparatus, it is difficult to provide various control power sources using large-size commercially available transformers in accordance with needs as in a conventional fashion. Further, since the control voltage is made lower, the above-noted problem is unavoidable.

Further, the detailed description of the invention will be given below.

The control apparatus for an elevator is conventionally constructed of a large number of relays so as to be controlled by the relay-sequence. Therefore, the voltage used in the apparatus is relatively made high on assumption that the voltage enough to operate electromagnetic coils is to be supplied thereto. Further, since the hoisting machine is operated by the action of an electromagnetic coil, the brake of the hoisting machine has also been driven with the same voltage of the power source.

However, as the electronic technology for the control apparatus advances to replace the relay-sequence control with the computer control, its control voltage becomes low.

Accordingly, if an electromagnetic coil for the low voltage is used, then the coil current at the time of attraction becomes relatively large, to thereby cause the voltage drop in a current supply line to the coil becomes large. Further, such a power source device as to have a large current capacity is required. In some cases, the attraction is liable to be difficult.

Furthermore, in the case where the voltage applied to the brake coil 14 is low, the flowing current is small and the attracting force is also low, thereby causing the motion slow and deteriorating the controllability. For this reason a separate power source remains to be provided for the brake coil. However, currently, since the most of the circuits are made electronic, it is required to eliminate the kinds of power sources.

The present invention has been made in view of the above, and therefore has an object of the present invention to provide a brake control apparatus for an elevator, which, in association with a tendency that the power source becomes lower in voltage, even if it is not provided with a power source having a high voltage that is necessary and sufficient at the time of the brake release, and even if it is provided with only one DC power source, can realize the brake release action by immediately supplying the necessary energy to the brake coil independently of the power source voltage at the time of the brake release.

DISCLOSURE OF THE INVENTION

A brake control apparatus for an elevator according to one aspect of the present invention comprises:

a control means for ascendingly/descendingly controlling an elevator cage;

a brake means, having a brake wheel provided on a rotary shaft of a drive motor of a hoisting machine allowing the elevator cage to ascend/descend, for braking the rotation of the drive motor by clamping the brake wheel with a lining attached to a plunger depressed by a spring force, and releasing the brake wheel by attracting the plunger against the depressing force of the spring by exciting a brake coil wound around the plunger;

a brake releasing means for releasing the brake wheel by exciting the brake coil based on an instruction sent from the control means; and an auxiliary power source means for charging an energy or a part of the energy necessary for driving the brake coil at the time of the release of the brake wheel, and exciting the brake coil using the energy charged at the time of the release of the brake wheel.

Also, the auxiliary power source means supplies the energy, which is charged prior to the release of the brake wheel, to the brake means at the time of the release of the brake wheel so as to excite the brake coil, thereby attracting the plunger and releasing the brake wheel.

Also, the auxiliary power source means supplies the power source to the brake coil on the basis of a brake release instruction at the time of the release of the brake wheel, and the brake release means supplies the power source to the brake coil after the brake wheel is actually released subsequently to the brake release instruction, to thereby maintain the release of the brake wheel.

Also, a release detector is further provided for detecting the release of the brake wheel. A predetermined time period, in which the power source is supplied to the brake coil using the auxiliary power source means at the time of the release of the brake wheel, runs from a time point at which the brake release instruction is outputted to excite the brake coil up to a time point at which the release detector detects the release of the brake wheel.

Also, the auxiliary power source means includes a voltage boosting means for boosting the power source voltage inputted therein, and a condenser for charging therein the voltage boosted by the voltage boosting means, and a current based on the boosted voltage charged in the condenser and a current through the voltage boosting means are supplied to the brake coil.

Also, the auxiliary power source means applies a first boosted voltage to the brake coil at the time of the release of the brake wheel, and applies a second voltage lower than the first boosted voltage to the brake coil when the brake release is to be held.

Also, a brake control apparatus for an elevator according to another aspect of the present invention comprises:

a control means for ascendingly/descendingly controlling an elevator cage;

a brake means, having a brake wheel provided on a rotary shaft of a drive motor of a hoisting machine allowing the elevator cage to ascend/descend, for braking the rotation of the drive motor by clamping the brake wheel with a lining attached to a plunger depressed by a spring force, and releasing the brake wheel by attracting the plunger against the depressing force of the spring with an excited brake coil wound around the plunger;

a brake releasing means for releasing the brake wheel by exciting the brake coil;

a brake power source connected to the brake releasing means through a contact that is closed based on a brake release instruction, the brake power source including auxiliary power source means, in accordance with the need, for boosting a power source voltage to be supplied; and a voltage boosting instruction means for instructing the brake power source to supply the voltage-boosted power source to the brake releasing means from a time point at which the brake release instruction is outputted so that the brake is activated up to a time point at which the brake is released.

Further, the auxiliary power source means applies a first boosted voltage to the brake coil at the time of the release of the brake wheel, and applies a second voltage lower than the first boosted voltage to the brake coil when the brake release is to be held.

BEST MODE FOR CARRYING-OUT THE INVENTION

First Embodiment

Figure 1:
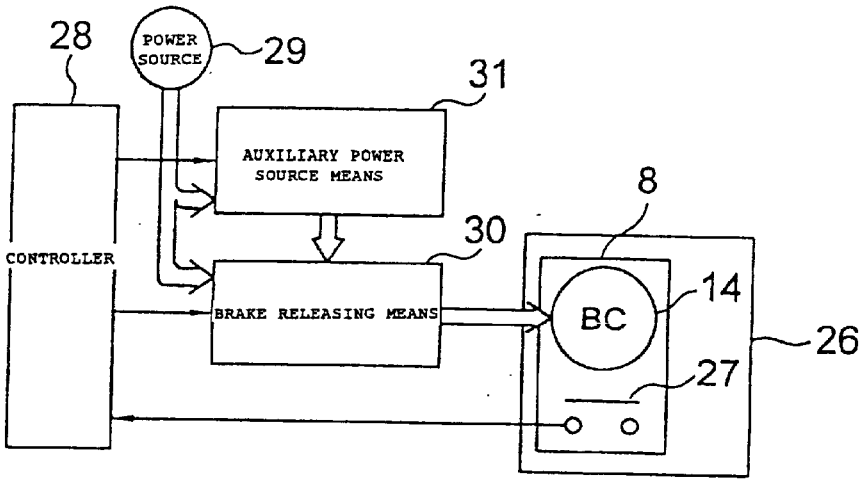
FIG. 1 is a block diagram showing the structure of a brake control apparatus for an elevator according to a first embodiment of the present invention.
Figure 6:
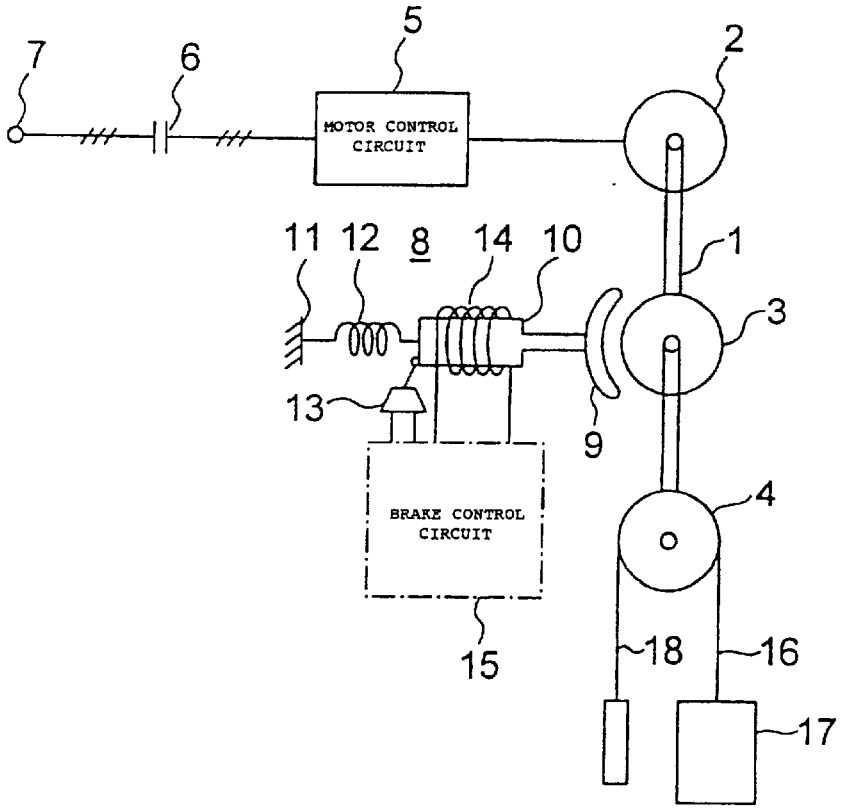
FIG. 6 PRIOR ART
FIG. 6 is a schematic diagram showing a typical structure of a conventional elevator apparatus similar to that disclosed in Japanese Patent Application Laid-open No. Hei 2-110090.

FIG. 1 is a block diagram showing the structure of a brake control apparatus for an elevator according to a first embodiment of the present invention, which mainly corresponds to the function of a brake control circuit 15 shown in FIG. 6.

In FIG. 1, reference numeral 26 designates a hoisting machine for raising and lowering an elevator cage, which includes a drive motor, a brake wheel and a sheave similar to the apparatus shown in FIG. 6. The hoisting machine 26 is provided with an electromagnetic brake 8 that is designed to brake the rotation of the motor by clamping the brake wheel with the aid of a lining attached to a plunger depressed by a force of a spring as well as to release the brake wheel such that the plunger is attracted against the force of the spring by an excited brake coil 14 wound around the plunger, and with a release detector 27 (similar in function to the member 13 shown in FIG. 6) for detecting the release of the brake wheel 3.

Reference numeral 28 designates a controller that serves as both motor control circuit and brake control circuit (reference numerals 5 and 15 shown in FIG. 6); 29, a DC power source of a relatively low voltage similar to one used for the computer control; 30, a brake release means for releasing the brake wheel by exciting the brake coil 14 in accordance with an instruction from the controller 28; and 31, an auxiliary power source means for storing therein the energy or a part of the energy necessary for driving the brake coil 14 at the time of the release of the brake wheel so as to excite the brake coil 14 using the stored energy at the time of the release of the brake wheel.

Figure 2:
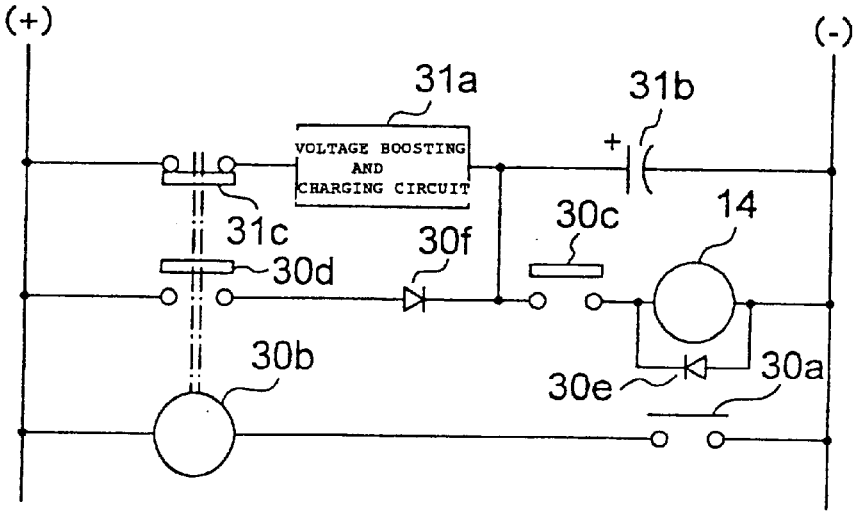
FIG. 2 is a circuit diagram specifically showing the brake control apparatus for an elevator shown in FIG. 1.

FIG. 2 shows a specific circuit of the aforementioned brake control apparatus shown in FIG. 1.

In FIG. 2, the brake release means 30 shown in FIG. 1 includes a brake release contact 30*a* that is closed based on an instruction from the controller 28 that receives the detection signal indicative of when the release of the brake wheel 3 is detected by the release detector 27, a power source switching contactor 30*b* connected in series between a positive terminal (+) of the DC power source 29 and a negative terminal (−) thereof together with the brake release contact 30*a*, a diode 30*f* connected in series between the positive and negative terminals of the DC power source 29 together with the normally open contact 30*d* and the brake coil 14, a brake release contactor contact 30*c* that is closed based on the brake release instruction from the controller 28, and a flywheel diode 30*e* connected in parallel to the brake coil 14.

The auxiliary power source means 31 shown in FIG. 1 includes a normally closed contact 31*c* of the power source switching contactor 30*b* and a voltage boosting and charging circuit 31*a* and an electrolytic condenser 31*b* which are connected in series between the positive and negative terminals of the DC power source 29 together therewith. The condenser 31*b* is connected in parallel to the serially connected assembly of the brake release contactor contact 30*c* and the brake coil 14.

Next, an operation of the brake control apparatus for an elevator thus constructed will be described with reference to the wave-form diagram of the respective portions shown in FIG. 3.

Before the brake release instruction is sent out from the controller 28, the electromagnetic brake 8 is not released, and the brake release detector contact 30*a* is open, so that the power source switching contactor 30*b* is not energized. Therefore, the condenser 31*b* is charged to have a voltage $V_c$ boosted from a voltage $V_p$ of the DC power source 29 due to a passage the positive terminal (+) of the DC power source 29—normally closed contact 31*c* of the power source switching contactor—the voltage boosting and charging circuit 31*a*—the condenser 31*b* and the negative terminal (−) of the DC power source 29.

In this condition, if the brake release instruction is sent out from the controller 28 (a time point an in FIG. 3), then the brake release contactor contact 30*c* is closed, and the boosted voltage is applied to the brake coil 14 connected in parallel to the condenser 31*b*. Therefore, the current flows from the condenser 31*b* to the brake coil 14 to excite the brake coil 14, whereby the plunger 10 shown in FIG. 6 is attracted against the depressing force of the spring 12 to release the brake wheel 9.

In addition, in this circuit, the current is supplied to the brake coil 14 not only from the condenser 31*b* but also the voltage boosting and charging circuit 31*a* so as to facilitate the releasing action. At this time, by limiting the current supplied from the voltage boosting and charging circuit 31*a*, it is also possible to reduce the instantaneous current load associated with the release on the power source side.

Figure 3:
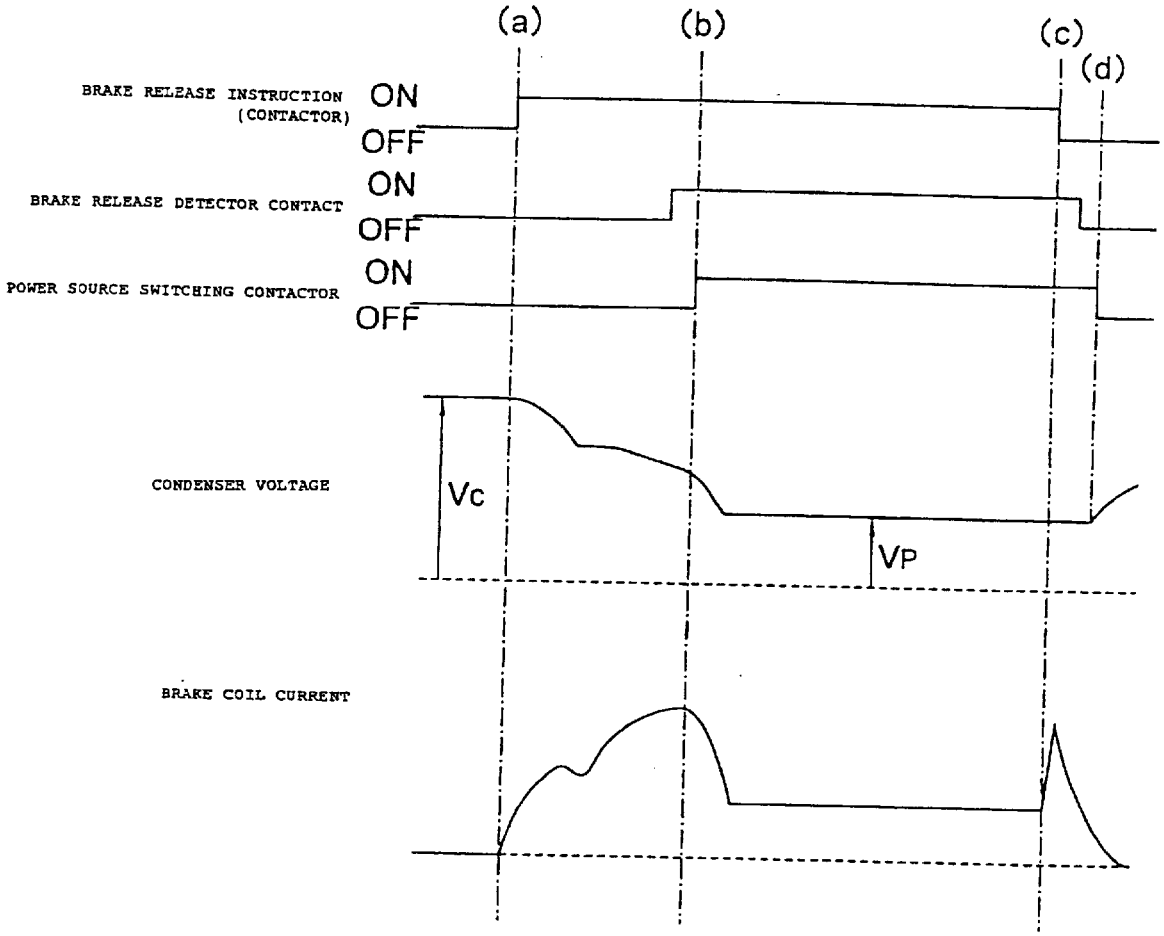
FIG. 3 is a diagram showing wave-forms in respective portions of FIG. 2.

When the brake is released in this manner, the brake release detector contact 30*a* is closed to energize the power source switching contactor 30*b* (a time point b in FIG. 3). The excited power source switching contactor 30*b* makes the normally closed contact 31*c* open and the normally open contact 30*d* closed. Therefore, the power source (the positive terminal) side of the voltage boosting and charging circuit 31*a* is separated, and the condenser 31*b* is connected to the power source (the positive terminal) side through a reverse flow preventive diode 30*f*.

Consequently, the condenser voltage is lowered due to the discharge, and becomes substantially equal to the power source voltage $V_p$. The current to the brake coil 14 is reduced due to the lowering of the condenser voltage. A constant current is finally held by the power source voltage.

Subsequently, when the brake release instruction from the controller 28 disappears, the brake release contactor contact 30*c* is open (a time point c in FIG. 3), the power supply to the brake coil 14 is interrupted, and the energy stored in the brake coil 14 is consumed by the current flowing through the diode 30*e* connected in parallel.

Since the brake release is ceased, the brake release detector contact 30*a* is opened and the excitation of the power source switching contactor 30*b* is ceased (a time point d in FIG. 3). This makes the normally closed contact 31*c* close again, so that the voltage boosting and charging circuit 31*a* is activated to voltage-boost and charge the condenser 31*b* again.

The operation and effect of the aforementioned first embodiment will be described.

The energy necessary for the brake release can be classified into two major types. That is, since the driving part of the brake includes the brake coil 14 and the plunger 10 attracted thereby, one is the energy for attracting and moving the plunger 10, and there is the energy by which the attraction of the plunger 10 is continued. As a matter of course, the former is larger in magnitude than the latter.

Accordingly, in the first embodiment, temporary storage, in the auxiliary power source means 31, of an energy or a part of the energy required at the instantaneous time (a predetermined period: the attraction time of the plunger 10) when the brake is released (attracted by the brake coil 14)

makes it possible to construct the DC power source 29 per se as a relatively low voltage power source.

In addition, the following two types are available as a method of the temporary storage:

One is a method of preliminarily storing the required energy prior to the brake release action, and the other is to temporally store the energy at the time of the brake release action to be added to contribute to the brake release action. In particular, an example of the latter serves such that the auxiliary power source means lowers the impedance of the circuit including the brake coil relative to the power source, and consequently, the current flowing in the brake coil can be boosted. In other words, it can be said that the power source is applied to the brake coil 14 while the voltage thereof is boosted by the auxiliary power source means 31.

In the first embodiment, by storing the required energy in the auxiliary power source means 31 before the brake is released, the storage can be preliminarily performed during a long time period to which the consideration as to the power source capacity to be supplied is applied. That is, it is not the case that the energy required during a short time period for the brake release is used immediately during that period. Therefore, it is possible to lower the power source capacity, or reduce the size of the electric power source wire from the power source 29 to the brake release means 30.

That is, if the supplied voltage to the brake release means 30 is lowered in association with the lowered voltage of the control circuit, the current necessary for the brake release is increased, and consequently the cost increase occurs to increase the rated current of the power source or to increase the capacity of the power source or size of the electric power source wire from the power source 29 to the brake release means 30. To overcome this problem, the first embodiment adopts such an arrangement that the energy, i.e., the current, required at the moment for the brake release is preliminarily stored using a small current, and then released at the time of the brake release. This makes it possible to suppress the increase of the power source equipment capacity only for the purpose of the temporary current.

In the first embodiment, the brake coil 14 is power-supplied by the auxiliary power source means 31 at the time of the brake release, and by the brake release means 30 if the release is continued to be maintained after a predetermined time period has passed from the brake release. Therefore, since the circuit of the brake release means 30 relating to the power source is basically required to have the power source capacity only for holding the brake, the circuit construction can be made simple and small in capacity.

In the first embodiment, the release detector 27 for detecting the brake release is provided for the brake, and since the predetermined time period, in which the auxiliary power source means 31 is used at the time of the brake release, runs from a time point at which the brake release instruction is sent out to a time point at which the brake coil is energized to activate the release detector 27, the auxiliary power source means 31 is required until the brake is released. Immediately after the release is detected, the use of the auxiliary power source means 31 may be ceased.

Therefore, for example, according to the system in which the energy is preliminarily stored, it is possible to suppress the use of the auxiliary power source means 31 into a minimal level, and the amount of energy to be stored for the next brake release can be made small. Even in the system in which the auxiliary power source means 31 is activated only at the time of the release, the use thereof can be ceased immediately after the release is confirmed. Therefore, the rated time of the equipments constituting the auxiliary power source means 31 can be realized as a smaller value.

In the first embodiment, since the auxiliary power source means 31 has such a voltage boosting function as to output a voltage higher than the inputted power source voltage, the control on the brake coil 14 side is not required, and the boost of the voltage applied to the brake coil 14 makes it easily increase the drive current of the brake coil 14, and consequently the release energy can be poured into the brake coil 14 during a shorter time period.

Second Embodiment

Figure 4:
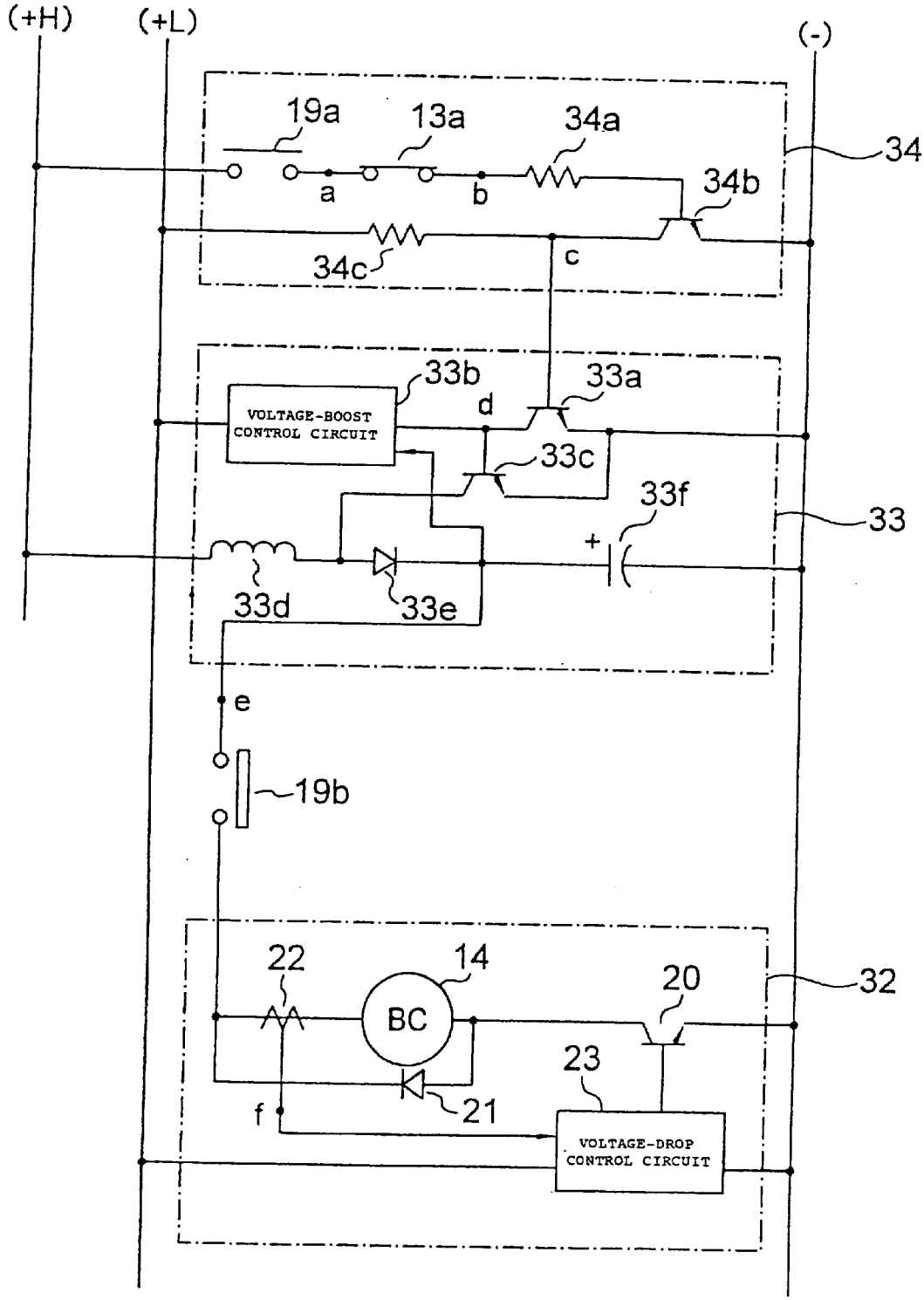
FIG. 4 is a circuit diagram showing the structure of a brake control apparatus for an elevator according to a second embodiment of the present invention.

FIG. 4 is a circuit diagram showing a structure of a brake control apparatus for an elevator according to a second embodiment of the present invention. The brake control apparatus for an elevator shown in FIG. 4 shows the circuit structure corresponding to the first embodiment shown in FIG. 2, and further, as similar to the first embodiment shown in FIG. 1, there are provided the DC power source 29, the hoisting machine 26 for ascending/descending the elevator cage 17 which includes the drive motor 2, the brake wheel 3 and the sheave 4 shown in FIG. 6, the electromagnetic brake 8 and the controller 28 shown in FIG. 1.

The DC power source 29 has a positive terminal (+H) of a high voltage for driving the coil, a positive terminal (+L) of a low voltage as a control power source, and a negative terminal (−) The positive terminal (+L) of the low voltage as the control power source may be provided, for instance, by lowering the voltage of the positive terminal (+H) of the high voltage for the coil drive, or may be common to a power source of a low voltage that is used for an electronic circuit for a computer control or the like.

Figure 7:
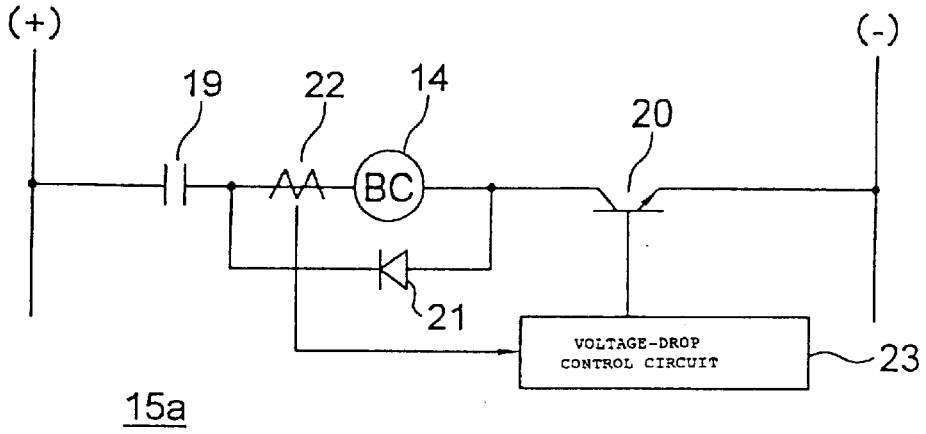
FIG. 7 PRIOR ART
FIG. 7 is a circuit diagram showing an example of a brake control circuit shown in FIG. 6.

In FIG. 4, reference numeral 32 designates a brake release means, which is similar in circuit construction to the conventional brake control circuit 15*a* shown in FIG. 7 and which releases the brake wheel 3 by exciting the brake coil 14.

This brake release means 32 is constructed of a transistor 20 for ON/OFF (chopping) control, an electric current detector 22 for detecting the current flowing in the brake coil 14, a flywheel diode 21 connected in parallel to the serially connected assembly of the brake coil 14 and the electric current detector 22 for enhancing the continuity of the current, and a voltage-drop control circuit 23 which, upon reception of the output of the electric current detector 22, generates a switching signal supplied to the base of the transistor 20 to current-control the coil current.

The collector of the transistor 20 is connected to the brake coil 14, and the emitter thereof is connected to the negative terminal (−) of the DC power source. The voltage-drop control circuit 23 is provided between the low voltage positive terminal (+L) of the DC power source, and the negative terminal (−) thereof.

Reference numeral 33 designates a brake power source having an auxiliary power source means which is connected to the brake release means 32 through an electromagnetic contactor contact 19*b* placed into closed state by the brake release instruction sent from a controller (similar to the controller 28 shown in FIG. 1), and which voltage-boosts the power source voltage supplied to the brake release means 32 depending on the need.

This brake power source 33 includes a transistor 33*a* whose emitter is connected to the negative terminal (−) of the DC power source, a voltage boosting control circuit 33*b* provided between the collector of the transistor 33*a* and the low voltage positive terminal (+L) of the DC power source, a transistor 33*c* whose base is connected to the collector of the transistor 33*a* and whose emitter is commonly connected to the emitter of the transistor 33*a*, a choke coil 33*d* connected between the high voltage positive terminal (+H) of the DC power source and the negative terminal (−) thereof, a flywheel diode 33*e*, and an electrolytic condenser 33*f*.

An anode of the diode 33*e* is connected to a collector of the transistor 33*c*, and a cathode thereof is connected to the voltage-boost control circuit 33*b* and the electromagnetic contactor contact 19*b*.

Reference numeral 34 designates a voltage boosting instruction means which instructs to the brake power source 33 to supply the voltage-boosted power source to the brake release means 32 during when the brake release instruction is sent out, the brake is started to be activated, and released.

This voltage boosting instruction means 34 includes an electromagnetic contactor contact 19*a* whose one end is connected to the high voltage positive terminal (+H) and which is closed by the brake release instruction sent from the controller as similar to the electromagnetic contactor contact 19*b*, a normally closed contact 13*a* of the switch which is connected to the other end of the electromagnetic contactor contact 19*a* and which is open at the time of the brake release in association with the plunger 10 of the electromagnetic brake 8, a current limiting resistor 34*a* connected to the other end of the normally closed contact 13*a*, a transistor 34*b* whose base is connected to the other end of the resistor 34*a* and whose emitter is connected to the negative terminal (−) of the DC power source, and a pull-up resistor 34*c* provided between the low voltage positive terminal (+L) of the DC power source and the collector of the transistor 34*b*.

The connection point between the transistor 34*b* and the pull-up resistor 34*c* is connected to the base of the transistor 33*a* of the brake power source 33.

Next, the operation of the brake control apparatus for an elevator according to a second embodiment of the present invention will be described with reference to the wave-form diagram of the respective portions shown in FIG. 5.

Figure 5:
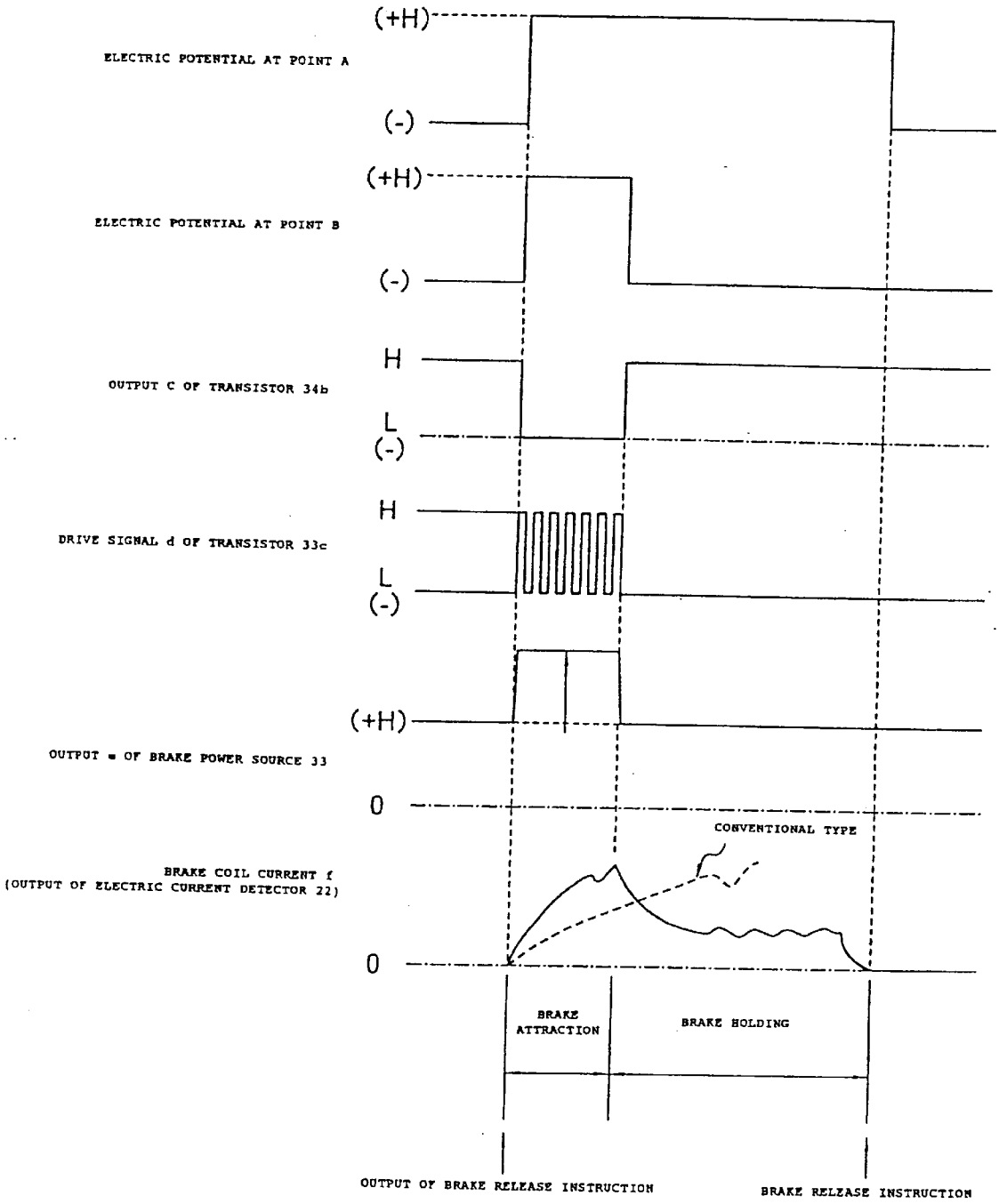
FIG. 5 is a diagram showing wave-forms in respective portions of FIG. 4.

When the brake release instruction is outputted based on the elevator drive instruction sent from the controller 28 (not shown) similar to that included in the first embodiment shown in FIG. 1, to thereby close the contact 19*a* in the voltage boosting instruction means 34, the electric potential at a point a (the connection point between the contact 19*a* and the contact 13*a*) is varied along with the motion of the contact 19*a* as shown in FIG. 5. The electric potential at a point b (the connection point between the contact 13*a* and the resistor 34*a*) presents a pulsed wave-form of (+H) level during only a time period runs from a time point at which the contact 19*a* is closed to attract the plunger 10 of the electromagnetic brake 8 up to a time point at which the contact 13*a* is open, as shown in FIG. 5. Similarly, the electric potential at a point C that is the collector of the transistor 34*b* presents a pulsed wave-form of the inversion logic as shown in FIG. 5.

Therefore, since the transistor 33*a* is set OFF when the electric potential at the point c is in the "L" level, the output of the voltage-boost control circuit 33*b* is applied to the base of the transistor 33*c*. Consequently, as shown in FIG. 5, the drive signal (the electric potential at a point d) of the transistor 33*c* is permitted during only a time period from a time point at which the contact 19*a* is closed up to a time point at which the contact 13*a* is open, that is, only a time period up to the attraction of the plunger 10, and thus the ON/OFF signal described later is outputted.

Here, the operation of the brake power source 33 will be described briefly.

The energy is transmitted such that the energy charged in the choke coil 33*d* during the ON period of the transistor 33*c* is released to the electrolytic condenser 33*f* through the flywheel diode 33*e* during the OFF period of the transistor 33*c*, and the output voltage (the electric potential at a point e) is voltage-boosted to be higher in level than the high voltage positive terminal (+H) of the DC power source (the voltage is boosted by an amount corresponding to the energy charged in the choke coil 33*d*).

By controlling the ON/OFF duty of this transistor 33*c*, the boosted voltage can be controlled to be a desired value. That is, it serves as a so-called voltage boosting chopper circuit.

As described above, the voltage-boost control circuit 33*b* ON/OFF-controls the switching of the transistor 33*c* so that the voltages on both ends of the electrolytic condenser 33*f* become predetermined voltages.

Therefore, the output voltage of the brake power source 33 presents such a wave-form that the voltage is boosted to a desired value only when the electromagnetic brake is attracted, as shown in FIG. 5. The current (the output of the electric current detector 22) f flowing the brake coil 14 immediately raised up to release the brake wheel 3 quickly as shown in FIG. 5, since the voltage-drop control circuit 23 of the brake release means 32 is not activated at the time of the attraction of the electromagnetic brake, the transistor 20 is in the ON condition, and the DC voltage boosted by the brake power source 33 is directly applied to the brake coil 14.

In this embodiment, the reason why the instantaneous variation (distortion) occurs in the brake coil current is that the inductance of the brake coil 14 is varied when the plunger 10 of the electromagnetic brake 8 is moved. In the conventional system in which the brake power source 33 is not applied, the brake coil current is slowly raised up to a present wave-form of the brake coil current f shown by a dotted line in FIG. 5, and therefore a longer time is required to release the brake and in some cases the brake cannot be released.

Once the electromagnetic brake is released, the brake power source 33 outputs the high voltage (+H) of the original power source voltage, since the transistor 33*a* is set ON to set the transistor 33*c* OFF, to thereby cease the voltage boosting activation. Further, the high voltage (+H) of the original DC power source is voltage-droppingly controlled by the voltage-drop control circuit 23, so that the brake release means 32 limits the current flowing the brake coil 14 to be a current capable of maintaining the holding of the electromagnetic brake.

According to the aforementioned second embodiment, it is possible to perform the brake release instantaneously even if the DC power source of only one system is provided as the control power source, and the power source can not supply the sufficiently high voltage enough to release the electromagnetic brake, instantaneously. of course, although the brake power source 33 may be continuously activated or the voltage boosting action may be continuously performed at the time of the brake release (the drive of the elevator), these are not preferable since problems arise in that the electric power is unnecessarily lost during the elevator stop and EMC noise is generated, and in view of the less electric power consumption-purpose, since the considerable electric power loss occurs on the transistor and flywheel diode of the brake power source at the time of the brake holding that does not require the voltage boost inherently.

Further, in this second embodiment, since the circuit is designed to boost the voltage only when the brake is attracted, it is possible to suppress the unnecessary electric power consumption and the generation of the EMC noise to minimal levels, and therefore it is possible to obtain the significantly low-loss, less electric power consumption, and low noise brake control apparatus.

Furthermore, in this second embodiment, it is possible to control the voltage, i.e. the current, applied to the brake coil 14 by ceasing a partial function, i.e. the voltage boosting function, of the brake power source 33 according to the need without any separate auxiliary power source means additionally provided.

Besides, although the description is given of a case in which the contact 19*a* that is closed by the brake release instruction in the voltage boosting instruction means 34 and the contact 19*b* for the brake coil activation are driven simultaneously, the contact 19*a* may be driven prior to the contact 19*b* to boost the condenser voltage in advance of the time point at which the contact 19*b* is driven.

In the second embodiment, the voltage-drop control circuit 23 is further provided to replace the aforementioned two step voltage control with the three step control, thereby further facilitating the low energy consumption effect.

Although it is described that the voltage-boost control circuit 33*b* remains active until the detector starts to be activated at the time of the brake release, the boosted voltage may be applied only for an initial predetermined time period in which the release instruction is sent out. Although the circuit structure is partially different from the present circuit structure, the similar effect can be obtained if the electric charge (energy) is preliminarily stored in the condenser so that the stored electric charge is released to the brake coil at the time of the brake release to facilitate the releasing action.

The voltage-boost control circuit 33*b* may be modified to generate a first boosted voltage before the brake release detector is activated, and thereafter to generate a voltage (this may be either of the boosted voltage and the dropped voltage with respect to the power source voltage (+H)) which is lower than the first boosted voltage and which is optimized to hold the brake release. In this case, therefore, the voltage-drop control circuit 23 may be dispensed with.

According to the second embodiment, the auxiliary power source means is included in the brake power source 33, and the brake power source 33 outputs the boosted voltage only for the predetermined time period at the time of the brake release. Consequently, the current flowing in the brake coil 14 can be increased to facilitate the brake releasing action. In addition, if the voltage boost instruction and the brake release instruction are concurrently outputted to the brake power source 33, the function of preliminarily charging the energy at the time of the brake release disappears, and thus the current on the power source side cannot be suppressed.

In the case where the first boosted voltage is applied to the brake coil at the time of the brake release to hold the brake release, the second voltage lower than the first boosted voltage is applied (see the output of the brake power source 33 shown in FIG. 5). Therefore, at the time of the brake holding, the voltage of the power source may be applied simply, or otherwise may be applied while being voltage-boosted (or voltage-dropped). That is, it cannot be said that the power source voltage of the present apparatus is appropriate for all brakes, and some brakes may require the higher voltage (or lower voltage).

It is possible to eliminate the need of a margin to be added to the applied voltage in view of the voltage fluctuation if a constant voltage function for maintaining the second voltage is possessed. Therefore, since the voltage can be set as low as the allowable one, it is possible to reduce the current supplied to the brake coil, thereby decreasing the amount of energy consumption associated with the brake release. Further, the continuity of the transistor in the chopper circuit of the brake power source 33 can be lowered to sufficiently lower the voltage, thereby suppressing the temperature increase on the element.

Industrial Applicability

As described above, according to the present invention, it is possible to provide a brake control apparatus for an elevator, which, in association with a tendency that the power source becomes lower in voltage, even if it is not provided with a power source having a high voltage that is necessary and sufficient at the time of the brake release, and even if it is provided with only one DC power source, can realize the brake release action by immediately supplying the necessary energy to the brake coil independently of the power source voltage at the time of the brake release.

What is claimed is:

1. A brake control apparatus for an elevator, comprising:

control means for controlling raising and lowering of an elevator cage;

brake means, having a brake wheel on a rotary shaft of a drive motor of a hoisting machine for raising and lowering the elevator cage, for braking rotation of the drive motor by clamping the brake wheel with a lining attached to a plunger biased by a spring, and releasing the brake wheel by retracting the plunger against force of the spring by supplying energy to a brake coil wound around the plunger;

brake releasing means for exciting the brake coil by supplying energy to the brake coil based on an instruction from the control means to release the brake wheel; and auxilary power source means for storing energy for driving the brake coil, and exciting the brake coil by supplying stored energy to said brake releasing means upon release of the brake wheel.

2. The brake control apparatus for an elevator according to claim 1, wherein the auxiliary power source means supplies the energy, which is stored prior to the release of the brake wheel, to the brake means upon the release of the brake wheel by exciting the brake coil, thereby retracting the plunger and releasing the brake wheel.

3. The brake control apparatus for an elevator according to claim 1, wherein the auxiliary power source means supplies energy to the brake coil in response to a brake release instruction upon the release of the brake wheel, and the brake releasing means supplies energy to the brake coil after the brake wheel is released, subsequent to the brake release instruction, to maintain the release of the brake wheel.

4. The brake control apparatus for an elevator according to claim 3, further comprising a release detector for detecting the release of the brake wheel, wherein energy is supplied to the brake coil from the auxiliary power source means from a time point at which the brake release instruction is outputted to excite the brake coil until a time point when the release detector detects the release of the brake wheel.

5. The brake control apparatus for an elevator according to claim 1, wherein the auxiliary power source means includes voltage boosting means for boosting a power source voltage, and a condenser charged by the voltage boosted by the voltage boosting means, and wherein a current based on the boosted voltage of the condenser and a current provided by the voltage boosting means are supplied to the brake coil.

6. The brake control apparatus for an elevator according to claim 1, wherein the auxiliary power source means applies a first boosted voltage to the brake coil upon the release of the brake wheel, and applies a second voltage, lower than the first voltage, to the brake coil in sustaining the brake release.

7. A brake control apparatus for an elevator, comprising:

control means for controlling raising and lowering of an elevator cage;

brake means, having a brake wheel on a rotary shaft of a drive motor of a hoisting machine for raising and lowering the elevator cage, for braking rotation of the drive motor by clamping the brake wheel with a lining attached to a plunger biased by a spring, and releasing the brake wheel by retracting the plunger against force of the spring by supplying energy to a brake coil wound around the plunger;

brake releasing means for releasing the brake wheel by exciting the brake coil;

a brake power source connected to the brake releasing means through a contact that is closed based on a brake release instruction, the brake power source including auxiliary power source means for boosting a power source voltage to be supplied; and voltage boosting instruction means for instructing the brake power source to supply the voltage-boosted power source voltage to the brake releasing means from a time point when the brake release instruction is outputted so that the brake is activated until the brake is released.

8. The brake control apparatus for an elevator according to claim 7, wherein the auxiliary power source means applies a first boosted voltage to the brake coil upon the release of the brake wheel, and applies a second voltage, lower than the first boosted voltage, to the brake coil when the brake release is sustained.

* * * * *